US007478040B2

(12) United States Patent
Thyssen et al.

(10) Patent No.: US 7,478,040 B2
(45) Date of Patent: Jan. 13, 2009

(54) METHOD FOR ADAPTIVE FILTERING

(75) Inventors: Jes Thyssen, Laguna Niguel, CA (US); Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 772 days.

(21) Appl. No.: 10/968,333

(22) Filed: Oct. 20, 2004

(65) Prior Publication Data

US 2005/0091046 A1 Apr. 28, 2005

Related U.S. Application Data

(60) Provisional application No. 60/515,712, filed on Oct. 31, 2003, provisional application No. 60/513,741, filed on Oct. 24, 2003.

(51) Int. Cl.
*G10L 21/02* (2006.01)
*G10L 21/00* (2006.01)
*G10L 11/06* (2006.01)

(52) U.S. Cl. ..... 704/228; 704/208; 704/226

(58) Field of Classification Search ..... None
See application file for complete search history.

(56) References Cited

U.S. PATENT DOCUMENTS

| | | | | |
|---|---|---|---|---|
| 5,745,871 | A * | 4/1998 | Chen | 704/207 |
| 5,864,798 | A * | 1/1999 | Miseki et al. | 704/225 |
| 6,381,570 | B2 * | 4/2002 | Li et al. | 704/233 |
| 6,584,441 | B1 * | 6/2003 | Ojala et al. | 704/500 |
| 7,072,717 | B1 * | 7/2006 | Wolf et al. | 607/57 |
| 2003/0088408 | A1 * | 5/2003 | Thyssen et al. | 704/228 |

FOREIGN PATENT DOCUMENTS

| | | | |
|---|---|---|---|
| EP | 0 673 017 | | 9/1995 |
| EP | 1 271 472 | A2 | 1/2003 |
| JP | 06202698 | A * | 7/1994 |

OTHER PUBLICATIONS

European Search Report, issued in EP Appl. No. 04025312.2 on Feb. 25, 2005, 5 pages.

Chen et al., "Adaptive Postfiltering For Quality Enhancement Of Coded Speech", IEEE Transaction On Speech and Audio Processing, New York, vol. 3, No. 1, Jan. 1995, pp. 59-71.

Bingxi et al., "Adaptive Postfilter In 16 KBPS LD-CELP Speech Coder", 3rd International Conference On Signal Processing, Beijing, China, vol. 1, Oct. 14, 1996, pp. 678-681.

* cited by examiner

*Primary Examiner*—David R Hudspeth
*Assistant Examiner*—Matthew J. Sked
(74) *Attorney, Agent, or Firm*—Sterne, Kessler, Goldstein & Fox P.L.L.C.

(57) ABSTRACT

A method for adaptive long-term filtering of an audio signal, such as a decoded speech signal. The method includes measuring a smoothed periodicity of an audio signal segment, such as an audio frame, wherein the smoothed periodicity is measured by low-pass filtering an instantaneous periodicity of the audio signal segment. The periodicity of the audio signal segment is then increased in a manner that depends upon whether the smoothed periodicity is less than a predetermined threshold. By utilizing a smoothed periodicity measurement in this fashion, more accurate control of the post-filter is provided as compared to conventional solutions. Additionally, the method includes deriving filters by interpolating between filter responses of adjacent audio signal segments to minimize distortion at segment boundaries.

22 Claims, 5 Drawing Sheets

METHOD FOR ADAPTIVE FILTERING

CROSS-REFERENCE TO RELATED APPLICATIONS

Figure 1:
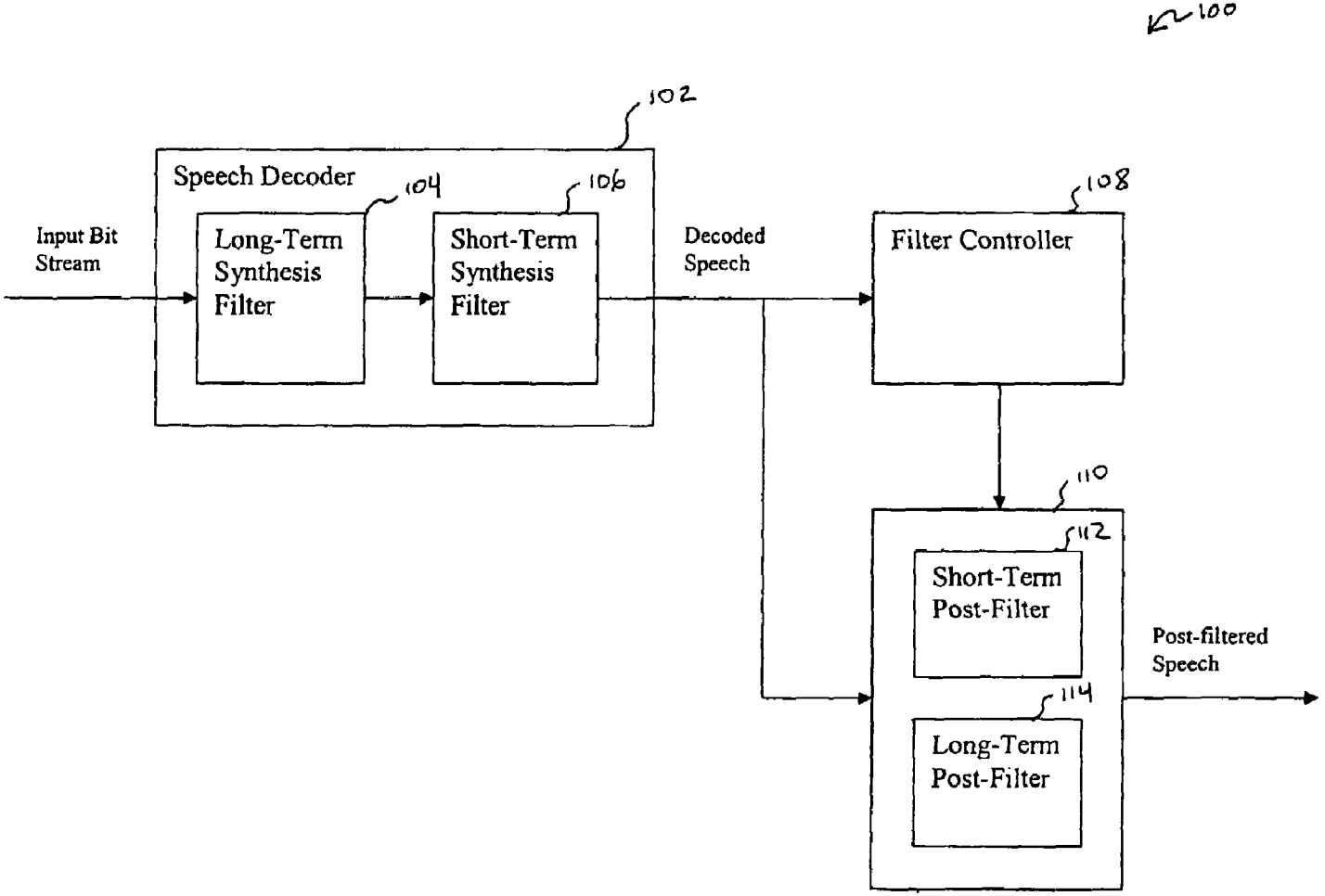

This application claims the benefit of U.S. provisional patent application No. 60/513,741 entitled "Parameter Adaptation for Post-Filtering", which was filed on Oct. 24, 2003, and U.S. provisional patent application No. 60/515,712 entitled "Systems and Methods for an Improved Speech Codec", which was filed Oct. 31, 2003. Both of these applications are hereby incorporated by reference as if fully set forth herein.

BACKGROUND OF THE INVENTION

1. Field of the Invention

The present invention relates generally to techniques for filtering signals, and more particularly, to techniques for filtering speech or other audio signals.

2. Background

In digital speech communication involving encoding and decoding operations, it is known that a properly designed filter applied at the output of the speech decoder is capable of reducing perceived coding noise, thereby improving the quality of the decoded speech. Such a filter is often called a post-filter and the post-filter is said to perform post-filtering. An adaptive post-filter is one in which the filter parameters are periodically modified to adapt to one or more local characteristics of the speech signal.

Adaptive post-filtering can be performed using a frequency-domain approach or time-domain approach. A known time-domain adaptive post-filter includes a long-term post-filter and a short-term post-filter. A long-term post-filter, which may also be referred to as a pitch post-filter, is used when the speech spectrum has a harmonic structure, for example, during voiced speech when the speech waveform is almost periodic. The long-term post-filter is typically used to attenuate spectral valleys between harmonics in the speech spectrum. In contrast, a short-term post-filter is typically used to attenuate the valleys in the spectral envelope, i.e., the valleys between formant peaks.

A known method for long-term post-filtering operates to increase the periodicity of the speech signal. For periodic signals, this increases the perceptual quality of the speech signal as the distortion between harmonic components is attenuated without affecting the harmonic components.

The operation of a typical all-zero long-term post-filter may be described by the following equation:

$$y(n)=g\cdot[x(n)+\gamma\cdot x(n-L)],$$

where x(n) is the input signal to the long-term post-filter, and y(n) is the post-filtered signal. The parameters g, γ, and L are typically adapted on a segment-by-segment basis to fit the local characteristics of the signal. The parameter γ controls the increase in periodicity (where L is the number of samples in the pitch period) and is typically derived from the input signal to the long-term post-filter to reflect the local periodicity of the signal, or as a function of a measure of periodicity provided by other means. For example, the parameter γ may be derived as a function of parameter(s) in a speech decoder such as pitch tap(s).

Similarly, the operation of a typical all-pole long-term post-filter may be described by:

$$y(n)=g\cdot[x(n)+\gamma\cdot y(n-L)].$$

In order to avoid increasing the periodicity of non-periodic signals it is advantageous to effectively disable the long-term post-filtering during non-periodic signal segments, where the γ parameter typically exhibits fluctuations and thus can incorrectly introduce periodicity. In practice, this is often achieved by setting the γ parameter to zero if a measure of the local periodicity of the signal exceeds a certain threshold. However, because the measure of local periodicity itself can exhibit fluctuations, this method can still result in less than desirable results.

Also, as noted above, the long-term post-filter parameters are typically adapted on a segment-by-segment basis to fit the local characteristics of the speech signal. The changing of the long-term post-filter parameters at segment boundaries can result in the introduction of undesired distortion into the speech signal.

What is desired then, is a method for adaptive long-term post-filtering that addresses one or more of the aforementioned shortcomings of conventional techniques.

BRIEF SUMMARY OF THE INVENTION

The present invention provides a method for adaptive long-term filtering of an audio signal, such as a decoded speech signal. In accordance with the invention, the degree of processing of the audio signal is adapted so that it is strong where strong post-filtering will benefit the signal, yet weak where it would otherwise degrade the signal.

In particular, a method in accordance with an embodiment of the present invention includes measuring a smoothed periodicity of an audio signal segment, such as an audio frame. The smoothed periodicity may be measured by low-pass filtering an instantaneous periodicity of the audio signal segment. During long-term post-filtering, the periodicity of the audio signal segment is increased in a manner that is dependent upon whether the smoothed periodicity is less than a predetermined threshold. By utilizing a smoothed periodicity measurement in this fashion, more accurate control of the post-filter is provided as compared to conventional solutions that use only a local or instantaneous measure of periodicity to control the long-term post-filter.

A method in accordance with a further embodiment of the present invention includes deriving parameters for a long-term post-filter by interpolating between filters of adjacent audio signal segments to minimize distortion at segment boundaries.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the art to make and use the invention.

FIG. 1 is a block diagram of an example system for decoding and post-filtering audio signals in which an embodiment of the present invention may be implemented.

Figure 2:
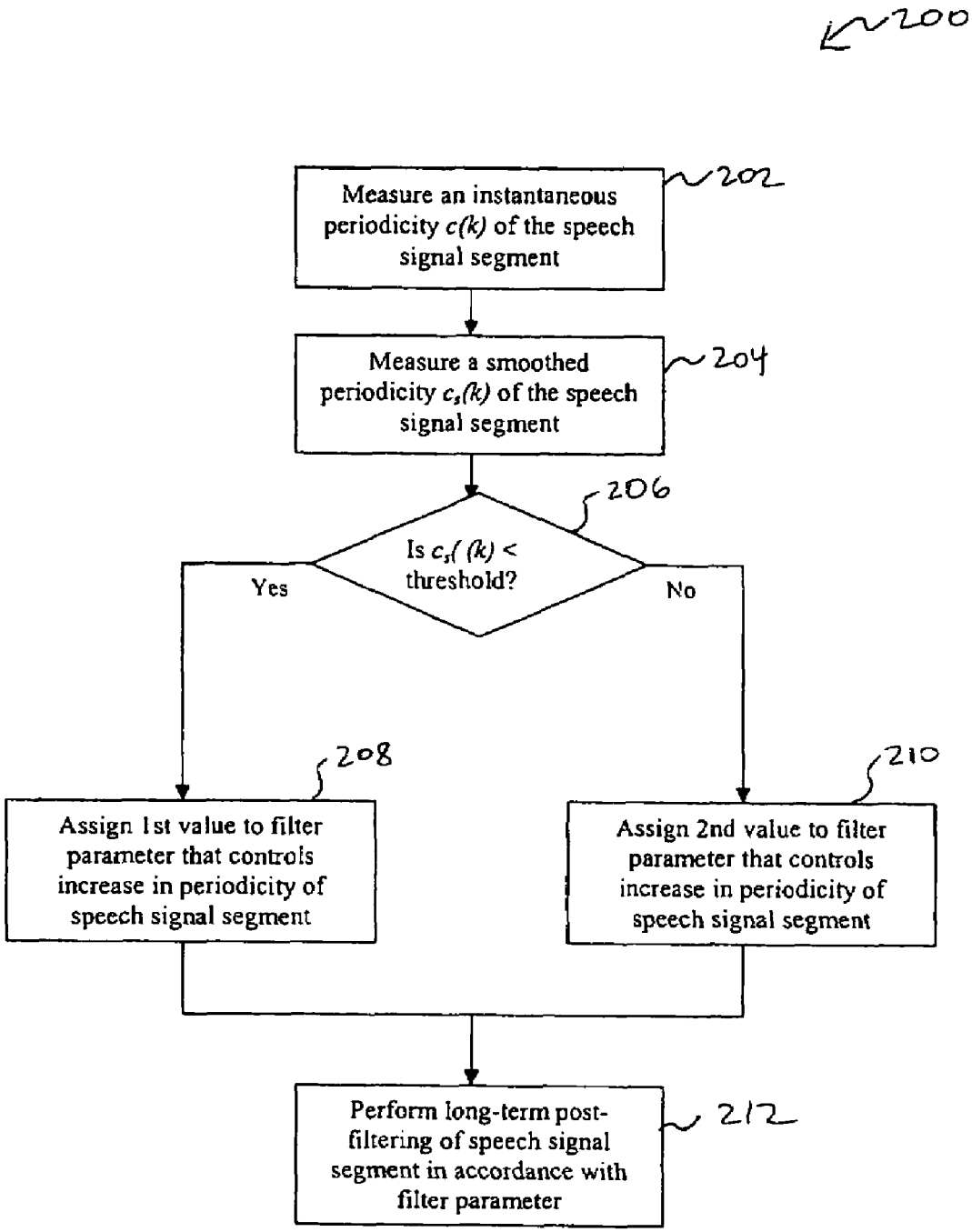
Figure 3:
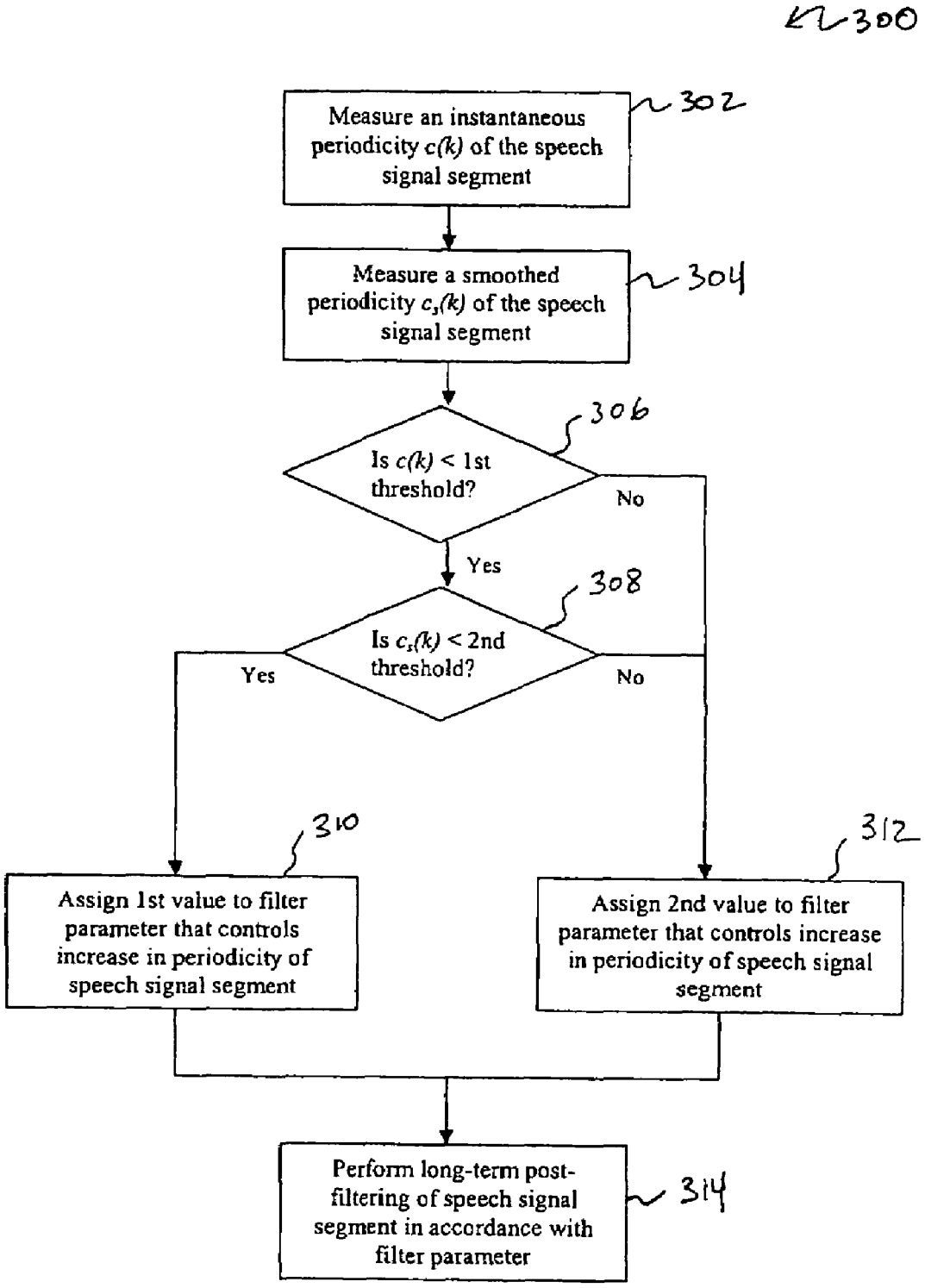
Figure 4:
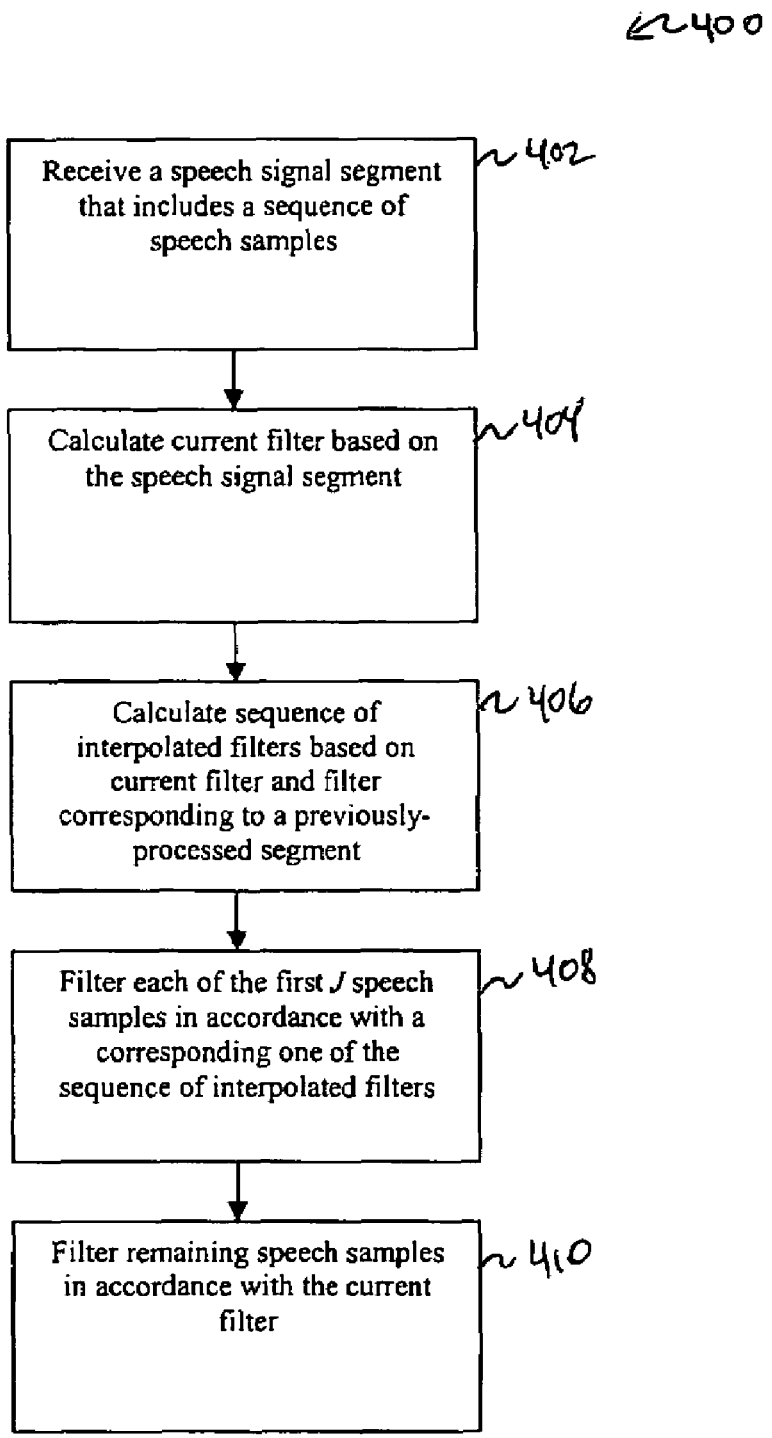

FIGS. 2, 3 and 4 each depict a flowchart of a method for performing long-term post-filtering of an audio signal in accordance with embodiments of the present invention.

Figure 5:
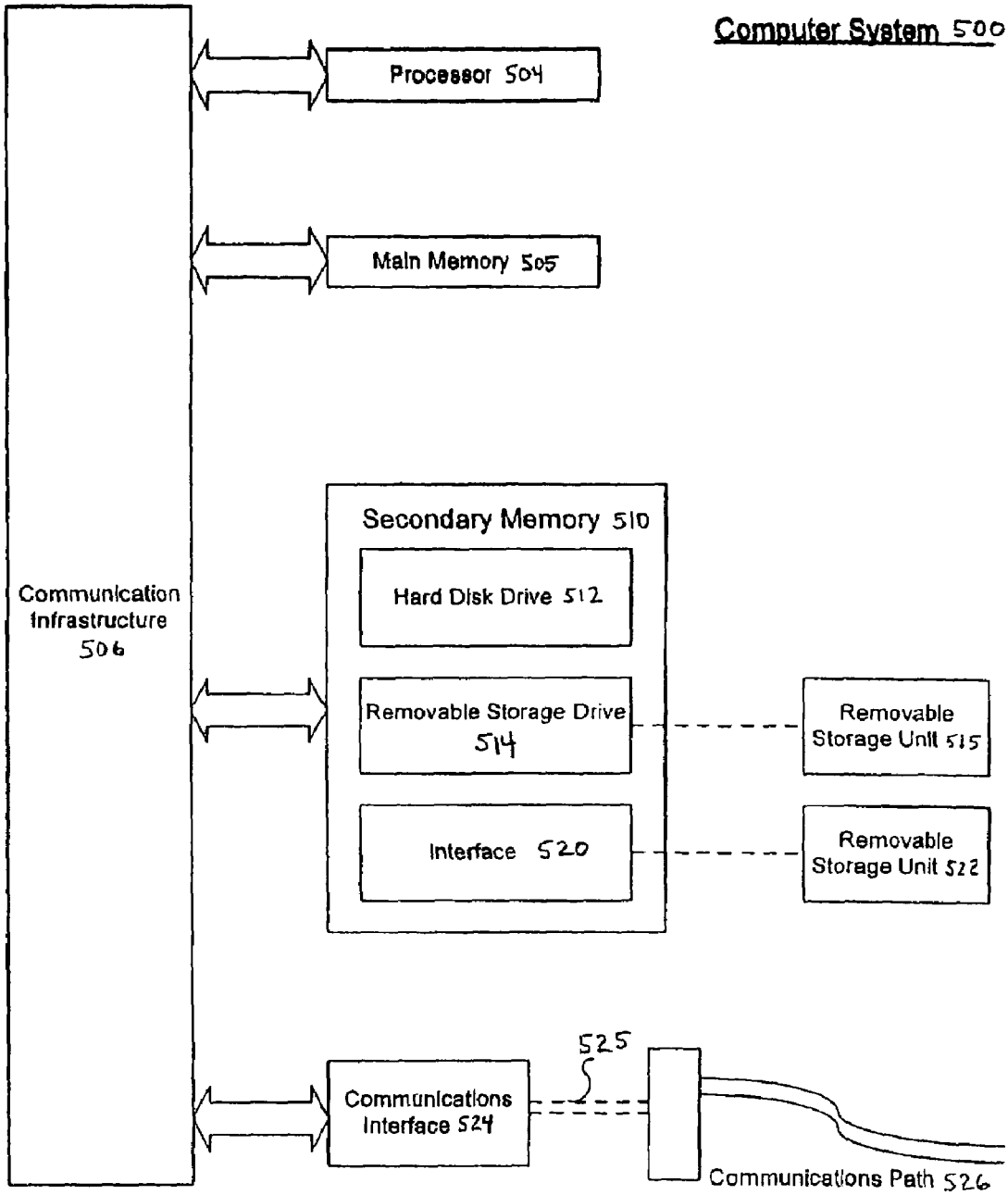

FIG. 5 is a block diagram of a computer system on which an embodiment of the present invention may operate.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. System Overview

FIG. 1 is a block diagram of an example system 100 for decoding and post-filtering audio signals in which an embodiment of the present invention may be implemented. System 100 is presented by way of example only. Persons skilled in the art will readily appreciate that the filtering methods of the present invention may be implemented in a wide variety of alternative systems and operating environments. Furthermore, although the following description of system 100 will focus on the processing of speech signals, it will be readily appreciated by persons skilled in the art that the concepts described herein may be also be applied to audio signals generally, and in particular to audio signals having periodic and non-periodic components.

As shown in FIG. 1, system 100 includes a speech decoder 102, a filter controller 108, and an adaptive post-filter 110 controlled by filter controller 108. Speech decoder 102 receives a bit stream representative of an encoded speech signal and decodes the bit stream to produce a decoded speech signal. The decoding process includes the steps of filtering the encoded speech signal using both a long-term synthesis filter 104 and a short-term synthesis filter 106. The decoded speech signal is organized into a series of discrete segments, such as frames or sub-frames. Each segment includes a predefined number of speech samples.

Filter controller 108 processes the decoded speech signal as well as other parameters received from decoder 102 to derive filter control signals and provides the control signals to adaptive post-filter 110. The filter control signals control the properties of adaptive post-filter 110 and include, for example, short-term filter coefficients for short-term post-filter 112 and long-term filter coefficients for long-term post-filter 114. Filter controller 108 re-derives or updates the filter control signals on a periodic basis. For example, filter controller 108 may update the filter control signals on a segment-by-segment basis.

Post-filter 110 receives and filters the decoded speech signal in a manner that is responsive to the periodically updated filter control signals. In particular, short-term and long-term post-filters 112 and 114 filter the decoded speech signal in accordance with the control signals. For example, short-term filter coefficients included in the control signals control a transfer function (for example, a frequency response) of short-term post-filter 112 and long-term filter coefficients in the control signals control a transfer function of long-term post-filter 114.

Since the control signals are updated periodically, post-filter 110 operates as an adaptive or time-varying filter in response to the control signals. The filtering function performed by post-filter 110 is also referred to as "post-filtering" since it occurs in the environment of a post-filter. Long-term post-filter 114 may precede short-term post-filter 112, or vice-versa.

Long-term post-filter 114 functions to selectively increase the periodicity of segments of the decoded speech signal. Filter controller 108 derives one or more filter parameters that control the amount by which long-term post-filter 114 will increase the periodicity of a current speech signal segment. The method by which filter controller 108 derives these parameter(s) and the effect that these parameters have on the function of long-term post-filter 114 will now be described in more detail.

B. Methods for Long-Term Post-Filter Operation and Control

FIG. 2 depicts a flowchart 200 of a method for performing long-term post-filtering of an audio signal in accordance with an embodiment of the present invention. The method of flowchart 200 will be described with continued reference to example system 100 of FIG. 1, although the invention is not limited to that embodiment.

The method begins at step 202, in which filter controller 108 measures an instantaneous periodicity of a segment of the decoded speech signal. At step 204, filter controller 108 measures a smoothed periodicity of the speech signal segment. The smoothed periodicity can be derived by low-pass filtering the instantaneous periodicity of decoded speech signal. By way of example, the smoothed periodicity can be calculated as:

$$c_s(k)=\alpha\cdot c_s(k-1)+(1-\alpha)\cdot c(k),$$

wherein c(k) represents the measure of periodicity at time k (or instantaneous periodicity), $c_s(k)$ represents the smoothed periodicity, $c_s(k-1)$ represents a smoothed periodicity of a previously-processed speech signal segment, and $\alpha$ represents a predefined parameter that controls the degree of smoothing.

At step 206, filter controller 108 compares the smoothed periodicity to a predetermined threshold. If the smoothed periodicity is below the predetermined threshold, then a non-periodic speech signal segment is indicated and filter controller 108 assigns a first value to a filter parameter $\gamma$ as shown at step 208. The filter parameter $\gamma$ controls the amount by which long-term post-filter 114 will increase the periodicity of the current speech signal segment. If the smoothed periodicity is above the predetermined threshold, then a periodic speech signal segment is indicated and filter controller 108 assigns a second value to $\gamma$ as shown at step 210.

In an embodiment, the first value is greater than 0 but less than the second value, and the assignment of the first value to $\gamma$ causes long-term post-filter 114 to reduce the increase in periodicity that would otherwise have been introduced if the second value was assigned. In an alternative embodiment, the first value is zero while the second value is non-zero, and the assignment of the first value to $\gamma$ prevents or disables long-term post-filter 114 from introducing any increase in periodicity whatsoever.

At step 212 long-term post-filter 114 post-filters the speech signal segment, wherein the increase in periodicity of the speech signal segment, if any, is controlled by the filter parameter $\gamma$. In an embodiment, the greater the value of $\gamma$, the greater the increase in the periodicity of the speech signal segment. The use of the smoothed periodicity $c_s(k)$ to select $\gamma$ facilitates more accurate control over long-term post-filter 114 as compared to conventional long-term post-filtering techniques that use only a measure of instantaneous periodicity to control the long-term post-filter, since the instantaneous periodicity is more susceptible to fluctuations.

FIG. 3 illustrates a flowchart 300 of an alternative method for performing long-term post-filtering in which both the instantaneous periodicity c(k) and the smoothed periodicity $c_s(k)$ are advantageously used to determine the value of γ. After c(k) and $c_s(k)$ are measured at steps 302 and 304, filter controller 108 compares c(k) to a first predetermined threshold and compares $c_s(k)$ to a second predetermined threshold, as shown at steps 306 and 308. If both periodicity measurements are less than their corresponding threshold, then a non-periodic speech segment is indicated and filter controller assigns a first value to γ as indicated at step 310. If either periodicity measurement exceeds their corresponding threshold, then a periodic speech segment is indicated and filter controller 108 assigns a second value to γ as indicated at step 312. At step 314, long-term post-filter 114 post-filters the speech signal segment, wherein the increase in periodicity is controlled by γ.

The method of flowchart 300 will now be further illustrated with reference to a specific example long-term post-filter implementation. We will assume that long-term post-filter 114 is an all-zero single tap long-term post-filter. The inputs used to derive the necessary filter parameters are a pitch period, pp, and an output signal sq(n) from short term synthesis filter 106, wherein sq(n) represents a decoded speech signal. The decoded speech signal is segmented into frames. For the first frame received, the history of sq(n) is set to zero. In principle, the long-term post-filtering is given by $$spf(n)=b_{pf}(1)sq(n)+b_{pf}(2)sq(n-pppf),\ n=1,2,\ldots FRSZ,$$

where spf(n) denotes the post-filtered output signal, pppf is the pitch period used for the long-term post-filter, n is the time index of the samples in the frame, and FRSZ is the total number of samples in the frame.

The pitch period of the decoder is refined by selecting a lag, pppf, corresponding to the highest squared normalized pitch correlation of the output signal in a ±4 sample range of the pitch period, pp. In other words, a lag pppf is selected that maximizes $$Csq(pppf)=\frac{\left[\sum_{n=1}^{FRSZ} sq(n)sq(n-pppf)\right]^2}{\left[\sum_{n=1}^{FRSZ} sq(n)sq(n)\right]\left[\sum_{n=1}^{FRSZ} sq(n-pppf)sq(n-pppf)\right]},$$

$pppf=pp_{min}, pp_{min}+1, \ldots, pp_{max}$, where $pp_{min}=pp-4$ and $pp_{max}=pp+4$, with the constraint that $$\text{if } pp_{min}<MINPP:\ pp_{min}=MINPP,\ pp_{max}=MINPP+8,$$

and similarly, $$\text{if } pp_{max}<MAXPP:\ pp_{max}=MAXPP,\ pp_{min}=MAXPP-8.$$

MINPP and MAXPP represent predefined minimum and maximum pitch periods, respectively. For 8 KHz sampled speech, MINPP may be set to 10 and MAXPP may be set to 136.

With the refined lag, the normalized pitch correlation is calculated as $$Cpf=\frac{\left[\sum_{n=1}^{FRSZ} sq(n)sq(n-pppf)\right]}{\sqrt{\left[\sum_{n=1}^{FRSZ} sq(n)sq(n)\right]\left[\sum_{n=1}^{FRSZ} sq(n-pppf)sq(n-pppf)\right]}}.$$

If the numerator is less than zero or the denominator is zero, the normalized pitch correlation is set to zero, Cpf=0. In this implementation, Cpf is used as the measure of instantaneous periodicity of the frame. Thus, this step corresponds to step 302 of FIG. 3.

Next, a running mean of the normalized pitch correlation is calculated as $$Crm(m)=0.75\ Crm(m-1)+0.25Cpf,$$

where Crm(m) is the running mean of the current frame, and Crm(m−1) is the running mean of the previous frame. For the first frame, the running mean of the previous frame may be set to zero, i.e., Crm(0)=0. In this implementation, Crm(m) is used as the measure of smoothed periodicity of the frame. Thus, this step corresponds to step 304 of FIG. 3.

Based on the normalized pitch correlation and the running means of the normalized pitch correlation, the initial long-term post-filter tap is calculated as $$a_{pf}=\begin{cases}0 & Crm(m)<0.55 \text{ and } Cpf<0.8\\ 0.3\ Cpf & \text{otherwise}\end{cases}$$

This comparison of Cpf to the threshold of 0.8 corresponds to step 306 of FIG. 3 while the comparison of Crm(m) to the threshold of 0.55 corresponds to step 308. The assignment of zero to the filter tap $a_{pf}$ corresponds to step 310 while the assignment of 0.3 Cpf to the filter tap $a_{pf}$ corresponds to step 312.

Subsequently, a scaling factor is calculated as $$g_{pf}=\sqrt{\frac{\sum_{n=1}^{FRSZ}[sq(n)]^2}{\sum_{n=1}^{FRSZ}[sq(n)+a_{pf}sq(n-pppf)]^2}}$$

The scaling factor is set to one if either the numerator or denominator is zero. The two long-term post-filter coefficients of the current (m-th) frame is calculated as $$b_{pf,m}(1)=g_{pf} \text{ and } b_{pf,m}(2)=g_{pf}a_{pf}.$$

Long-term post-filtering then occurs using these coefficients. This step corresponds to step 314 of FIG. 3.

FIG. 4 depicts a flowchart 400 of an additional method for performing post-filtering of an audio signal in accordance with an embodiment of the present invention. The method of flowchart 400 is intended to minimize any distortion originating from the changing of the post-filter parameters at segment boundaries. This is achieved by interpolating the filter impulse responses for the first J samples of each segment. The method of flowchart 400 will be described with continued reference to example system 100 of FIG. 1, although the invention is not limited to that embodiment. For example, the method of flowchart 400 is not limited to long-term post-filtering applications, but may be applied to other post-filtering applications as well, including but not limited to short-term post-filtering.

The method begins at step 402, in which filter controller 108 receives a speech signal segment from short-term synthesis filter 106 of speech decoder 102. The speech signal segment includes a sequence of individual speech samples. At step 404, filter controller 108 calculates a filter based on the current speech signal segment. For examples, in an embodiment, filter controller 108 calculates filter parameters for the long-term post-filter based on a measure of periodicity of the current speech signal segment. These filter parameters may be calculated in accordance with the methods described above in reference to FIGS. 2 and 3, or any other desirable method.

At step 406, filter controller 108 calculates a sequence of interpolated filters based both on the current filter and based on a filter corresponding to a previously-processed segment. The sequence of interpolated filters may be calculated such that the weight given to the filter from the previously-processed segment progressively decreases and/or the weight given to the current filter progressively increases. For example, linear interpolation may be used.

At step 408, post-filter 110 filters each of the first J speech samples in accordance with a corresponding one of the sequence of interpolated filters. At step 410, post-filter 110 filters each of the remaining samples in the speech segment in accordance with the current filter.

The foregoing method may be implemented in an all-zero pitch post-filter described by the equation $$y(n)=g\cdot[x(n)+\gamma\cdot x(n-L)].$$

This all-zero pitch post-filter can be expressed as $$y(n)=b_m(0)\cdot x(n)+b_m(1)\cdot x(n-L_m)$$

for segment m, and as $$y(n)=b_{m-1}(0)\cdot x(n)+b_{m-1}(1)\cdot x(n-L_{m-1})$$

for segment m−1. In accordance with the foregoing method, during the first J samples of segment m an interpolated long-term post-filter is used while the long-term post-filter of frame m is used for the remaining samples of the segment. This can be expressed as $$y(n)=b(n,0)\cdot x(n)+b(n,1)\cdot x(n-L_m)+b(n,2)\cdot x(n-L_{m-1})$$

where $$b(n,0)=\begin{cases}\beta(n)\cdot b_m(0)+(1-\beta(n))\cdot b_{m-1}(0) & n\le J\\ b_m(0) & n>J\end{cases},$$

$$b(n,1)=\begin{cases}\beta(n)\cdot b_m(1) & n\le J\\ b_m(1) & n>J\end{cases},$$

and $$b(n,2)=\begin{cases}(1-\beta(n))\cdot b_{m-1}(1) & n\le J\\ 0 & n>J\end{cases}$$

in which β(n) increases from approximately 0 to approximately 1 over the interpolation interval of J samples. This method effectively eliminates distortion due to the update of the long-term post-filter parameter updates.

With continued reference to the specific all-zero single tap long-term post-filter described above in reference to FIG. 3, an implementation of the foregoing method may likewise be expressed as $$spf(n)=b_{pf}(1,n)sq(n)+b_{pf}(2,n)sq(n-pppf_m)+b_{pf}(3,n)sq(n-pppf_{m-1}),\ n=1,2,\ldots FRSZ,$$

where $pppf_m$ and $pppf_{m-1}$ are the refined pitch period of the current and previous frames, respectively, and $$b_{pf}(1,n)=\begin{cases}\alpha(n)b_{pf,m}(1)+[1-\alpha(n)]b_{pf,m-1}(1) & n\le Lint\\ b_{pf,m}(1) & n>Lint\end{cases}$$

$$b_{pf}(2,n)=\begin{cases}\alpha(n)b_{pf,m}(2) & n\le Lint\\ b_{pf,m}(2) & n>Lint\end{cases}$$

$$b_{pf}(3,n)=\begin{cases}[1-\alpha(n)]b_{pf,m-1}(2) & n\le Lint\\ 0 & n>Lint\end{cases}$$

In accordance with this implementation, for the first Lint samples of each frame, the impulse responses of adjacent long-term post-filters are interpolated while the long-term post-filter of the current frame is used for the remaining samples of the segment. Lint may be set to 20. A linear interpolation between adjacent long-term post-filters can be used by calculating $$\alpha(n)=\frac{n}{Lint+1}.$$

For the first frame, the parameters of the previous long-term post-filter may be set to $pppf_0=100$, $b_0(1)=1$, and $b_0(2)=0$.

C. Hardware and Software Implementations

The following description of a general purpose computer system is provided for completeness. The present invention can be implemented in hardware, or as a combination of software and hardware. Consequently, the invention may be implemented in the environment of a computer system or other processing system. An example of such a computer system 500 is shown in FIG. 5. In the present invention, all of the signal processing blocks depicted in FIG. 1, for example, can execute on one or more distinct computer systems 500, to implement the various methods of the present invention. The computer system 500 includes one or more processors, such as processor 504. Processor 504 can be a special purpose or a general purpose digital signal processor. The processor 504 is connected to a communication infrastructure 506 (for example, a bus or network). Various software implementations are described in terms of this exemplary computer system. After reading this description, it will become apparent to a person skilled in the art how to implement the invention using other computer systems and/or computer architectures.

Computer system 500 also includes a main memory 505, preferably random access memory (RAM), and may also include a secondary memory 510. The secondary memory 510 may include, for example, a hard disk drive 512 and/or a removable storage drive 514, representing a floppy disk drive, a magnetic tape drive, an optical disk drive, etc. The removable storage drive 514 reads from and/or writes to a removable storage unit 515 in a well known manner. Removable storage unit 515, represents a floppy disk, magnetic tape, optical disk, etc. which is read by and written to by removable storage drive 514. As will be appreciated, the removable storage unit 515 includes a computer usable storage medium having stored therein computer software and/or data.

In alternative implementations, secondary memory 510 may include other similar means for allowing computer programs or other instructions to be loaded into computer system 500. Such means may include, for example, a removable storage unit 522 and an interface 520. Examples of such means may include a program cartridge and cartridge interface (such as that found in video game devices), a removable memory chip (such as an EPROM, or PROM) and associated socket, and other removable storage units 522 and interfaces 520 which allow software and data to be transferred from the removable storage unit 522 to computer system 500.

Computer system 500 may also include a communications interface 524. Communications interface 524 allows software and data to be transferred between computer system 500 and external devices. Examples of communications interface 524 may include a modem, a network interface (such as an Ethernet card), a communications port, a PCMCIA slot and card, etc. Software and data transferred via communications interface 524 are in the form of signals 525 which may be electronic, electromagnetic, optical or other signals capable of being received by communications interface 524. These signals 525 are provided to communications interface 524 via a communications path 526. Communications path 526 carries signals 525 and may be implemented using wire or cable, fiber optics, a phone line, a cellular phone link, an RF link and other communications channels. Examples of signals that may be transferred over interface 524 include: signals and/or parameters to be coded and/or decoded such as speech and/or audio signals and bit stream representations of such signals; any signals/parameters resulting from the encoding and decoding of speech and/or audio signals; signals not related to speech and/or audio signals that are to be processed using the techniques described herein.

In this document, the terms "computer program medium" and "computer usable medium" are used to generally refer to media such as removable storage drive 514, a hard disk installed in hard disk drive 512, and signals 525. These computer program products are means for providing software to computer system 500.

Computer programs (also called computer control logic) are stored in main memory 505 and/or secondary memory 510. Also, decoded speech segments, filtered speech segments, filter parameters such as filter coefficients and gains, and so on, may all be stored in the above-mentioned memories. Computer programs may also be received via communications interface 524. Such computer programs, when executed, enable the computer system 500 to implement the present invention as discussed herein. In particular, the computer programs, when executed, enable the processor 504 to implement the processes of the present invention, such as the methods illustrated in FIGS. 2, 3 and 4, for example. Accordingly, such computer programs represent controllers of the computer system 500. Where the invention is implemented using software, the software may be stored in a computer program product and loaded into computer system 500 using removable storage drive 514, hard drive 512 or communications interface 524.

In another embodiment, features of the invention are implemented primarily in hardware using, for example, hardware components such as application specific integrated circuits (ASICs) and gate arrays. Implementation of a hardware state machine so as to perform the functions described herein will also be apparent to persons skilled in the art.

D. Conclusion

While various embodiments of the present invention have been described above, it should be understood that they have been presented by way of example only, and not limitation. It will be understood by those skilled in the relevant art(s) that various changes in form and details may be made wherein without departing from the spirit and scope of the invention as defined in the appended claims. For example, although the embodiments described above are described as filtering speech signals, the present invention is equally applicable to the filtering of audio signals generally, and in particular to audio signals exhibiting both periodic and non-periodic components. Accordingly, the breadth and scope of the present invention should not be limited by any of the above-described exemplary embodiments, but should be defined only in accordance with the following claims and their equivalents.

What is claimed is:

1. A method for processing a speech signal, comprising:

measuring an instantaneous periodicity of a speech signal segment;

measuring a smoothed periodicity of the speech signal segment;

increasing a periodicity of the speech signal segment in a manner dependent upon whether the instantaneous periodicity of the speech signal segment is below a first predetermined threshold and whether the smoothed periodicity of the speech signal segment is below a second predetermined threshold.

2. The method of claim 1, wherein measuring an instantaneous periodicity of the speech signal segment comprises measuring an instantaneous periodicity of the speech signal segment based on a pitch period corresponding to the speech signal segment.

3. The method of claim 2, wherein the speech signal segment consists of a frame of speech samples with n=1, 2, . . . , FRSZ corresponding to sample time indices of the frame, and wherein measuring an instantaneous periodicity of the speech signal segment based on a pitch period corresponding to the speech signal segment comprises calculating:

$$Cpf = \frac{\left[\sum_{n=1}^{FRSZ} sq(n)sq(n-pppf)\right]}{\sqrt{\left[\sum_{n=1}^{FRSZ} sq(n)sq(n)\right]\left[\sum_{n=1}^{FRSZ} sq(n-pppf)sq(n-pppf)\right]}}$$

wherein Cpf represents the instantaneous periodicity of the speech signal segment, sq(n) represents the speech sample at sample time index n, and pppf represents the pitch period corresponding to the speech signal segment.

4. The method of claim 3, wherein measuring a smoothed periodicity of the speech signal segment comprises calculating:

$$Crm(m)=0.75\ Crm(m-1)+0.25\ Cpf,$$

wherein Crm(m) represents the smoothed periodicity of the speech signal segment and Crm(m-1) represents the smoothed periodicity of a previously-processed speech signal segment.

5. The method of claim 1, wherein measuring the smoothed periodicity of the speech signal segment comprises low-pass filtering the instantaneous periodicity of the speech signal segment.

6. The method of claim 1, wherein measuring the smoothed periodicity of the speech signal segment comprises calculating:

$$c_s(k)=\alpha\cdot c_s(k-1)+(1-\alpha)\cdot c(k),$$

wherein $c_s(k)$ represents the smoothed periodicity of the speech signal segment, $c_s(k-1)$ represents a smoothed periodicity of a previously-processed speech signal segment, c(k) represents the instantaneous periodicity of the speech signal segment, and $\alpha$ represents a predefined parameter that controls the degree of smoothing.

7. The method of claim 1, wherein increasing a periodicity of the speech signal segment in a manner dependent upon whether the instantaneous periodicity of the speech signal segment is below a first predetermined threshold and the smoothed periodicity of the speech signal segment is below a second predetermined threshold comprises:

assigning a first value to a filter parameter if the instantaneous periodicity is below the first predetermined threshold and the smoothed periodicity is below the second predetermined threshold;

assigning a second value to the filter parameter if the instantaneous periodicity is above the first predetermined threshold or the smoothed periodicity is above the second predetermined threshold, wherein the second value is greater than the first value; and filtering the speech signal segment, wherein the filtering increases a periodicity of the speech signal segment in a manner that is controlled by the value of the filter parameter such that the greater the value of the filter parameter the greater the increase in the periodicity of the speech signal segment.

8. The method of claim 7, wherein assigning a first value to a filter parameter comprises assigning a value of zero to the filter parameter, thereby disabling the filtering from increasing the periodicity of the speech signal segment.

9. The method of claim 7, wherein assigning a second value to the filter parameter comprises assigning a value that is a factor of Cpf to the filter parameter, wherein Cpf represents the instantaneous periodicity of the speech signal segment.

10. The method of claim 1, further comprising:

receiving the speech signal segment from a speech decoder.

11. The method of claim 10, wherein receiving the speech signal segment from a speech decoder comprises receiving the speech signal segment from a short-term synthesis filter of the speech decoder.

12. A method for processing a speech signal, comprising:

receiving a speech signal segment, the speech signal segment comprising a sequence of speech samples;

calculating a current filter based on the speech signal segment;

calculating a sequence of interpolated filters based on the current filter and on a previous filter, wherein the previous filter corresponds to a previously-processed speech segment;

filtering each of the first J speech samples in the sequence of speech samples in accordance with a corresponding one of the sequence of interpolated filters; and filtering the remaining speech samples in the sequence of speech samples in accordance with the current filter.

13. The method of claim 12, wherein calculating a sequence of interpolated filters based on the current filter and on the previous filter comprises progressively decreasing the weight given to the previous filter when calculating each of the sequence of interpolated filters.

14. The method of claim 12, wherein calculating a sequence of interpolated filters based on the current filter and on the previous filter comprises progressively increasing the weight given to the current filter when calculating each of the sequence of interpolated filters.

15. The method of claim 12, wherein calculating a sequence of interpolated filters based on the current filter and on the previous filter comprises linearly interpolating between the previous filter and the current filter.

16. The method of claim 12, wherein calculating a current filter based on the speech signal segment comprises calculating the current filter based on a periodicity of the speech signal segment.

17. The method of claim 16, wherein calculating the current filter based on a periodicity of the speech signal segment comprises calculating an instantaneous periodicity of the speech signal segment and calculating a smoothed periodicity of the speech signal segment.

18. The method of claim 17, wherein calculating the current filter further comprises:

assigning a first value to a filter tap if the smoothed periodicity is below a predetermined threshold; and assigning a second value to the filter tap if the smoothed periodicity is above the predetermined threshold.

19. The method of claim 17, wherein calculating the current filter further comprises:

assigning a first value to a filter tap if the smoothed periodicity is below a first predetermined threshold and the instantaneous periodicity is below a second predetermined threshold;

assigning a second value to the filter tap if the smoothed periodicity is above the first predetermined threshold or the instantaneous periodicity is above the second predetermined threshold.

20. The method of claim 12, wherein filtering the speech samples increases a periodicity of the speech signal segment.

21. The method of claim 12, wherein receiving a speech signal segment comprises receiving a speech signal segment from a speech decoder.

22. The method of claim 21, wherein receiving a speech signal segment from a speech decoder comprises receiving a speech signal segment from a short-term synthesis filter of a speech decoder.

* * * * *